US011313596B2

(12) United States Patent
Jeong et al.

(10) Patent No.: US 11,313,596 B2
(45) Date of Patent: Apr. 26, 2022

(54) EVAPORATOR AND REFRIGERATOR HAVING SAME

(71) Applicant: LG ELECTRONICS INC., Seoul (KR)

(72) Inventors: Minjae Jeong, Seoul (KR); Seungyoun Kim, Seoul (KR); Geunhyung Lee, Seoul (KR); Hyunwoo Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 517 days.

(21) Appl. No.: 16/332,443

(22) PCT Filed: Aug. 7, 2017

(86) PCT No.: PCT/KR2017/008513
§ 371 (c)(1),
(2) Date: Mar. 12, 2019

(87) PCT Pub. No.: WO2018/048102
PCT Pub. Date: Mar. 15, 2018

(65) Prior Publication Data

US 2021/0278112 A1 Sep. 9, 2021

(30) Foreign Application Priority Data

Sep. 12, 2016 (KR) ..... 10-2016-0117506

(51) Int. Cl.
*F25D 21/06* (2006.01)
*F25B 39/00* (2006.01)
(Continued)

(52) U.S. Cl.
CPC ..... *F25B 39/00* (2013.01); *F25D 21/08* (2013.01); *F25D 21/12* (2013.01); *F25B 39/024* (2013.01); *F25D 2400/02* (2013.01)

(58) Field of Classification Search
CPC ..... F25B 39/00; F25B 39/024; F25B 39/02; F25B 39/022; F25B 2339/022;
(Continued)

(56) References Cited

U.S. PATENT DOCUMENTS 4,485,643 A * 12/1984 Kato ..... F25B 39/022 62/519
2008/0104973 A1* 5/2008 Hall ..... F25D 21/08 62/80

FOREIGN PATENT DOCUMENTS

EP 0 854 771 10/1999
GB 854711 * 11/1960 ..... F25B 39/024
(Continued)

OTHER PUBLICATIONS

Attached pdf file is the translation of foreign reference GB854711 (Year: 1960).*

(Continued)

*Primary Examiner* — Henry T Crenshaw
*Assistant Examiner* — Kamran Tavakoldavani
(74) *Attorney, Agent, or Firm* — KED & Associates LLP

(57) ABSTRACT

Disclosed is an evaporator, comprising: a heating tube left as an empty space between first and second case sheets, which form an evaporator case, so as not to be overlapped with a cooling tube, and forming a heating passage in which a working liquid for defrosting flows; and a heater attached to the outer surface, which corresponds to the heating tube, of the evaporator case so as to heat the working liquid inside the heating tube. The heating tube can have a structure which an inlet and an outlet are respectively formed at both sides of a heater attachment part in the longitudinal direction and both end portions of a passage part are respectively connected to the inlet and the outlet, or can have a structure in which an opening is formed at one side of the heater attachment part, the working liquid heated by the heater is
(Continued)

discharged through the opening, and the cooled working liquid is returned. The structures can form the heating passage, enabling the working liquid to circulate therethrough, without forming the inlet and the outlet, which are respectively connected to both end portions of the passage part, to be parallel at one side of the heater attachment part.

20 Claims, 10 Drawing Sheets

(51) Int. Cl.

| | |
|---|---|
| ***F25D 21/08*** | (2006.01) |
| ***F25D 21/12*** | (2006.01) |
| *F25B 39/02* | (2006.01) |

(58) Field of Classification Search
CPC .... F25B 2339/023; F25D 21/08; F25D 21/12; F25D 21/06; F25D 2400/02
USPC ..... 62/276
See application file for complete search history.

(56) References Cited

FOREIGN PATENT DOCUMENTS

| | | | |
|---|---|---|---|
| GB | 854771 | * 11/1960 | ..... F25B 39/024 |
| JP | 8-313144 | 11/1996 | |
| KR | 20-0126728 | 11/1998 | |
| KR | 10-1999-001053 | 1/1999 | |
| KR | 10-0246378 | 4/2000 | |
| KR | 10-2003-0088657 | 11/2003 | |
| KR | 10-2004-0087645 | 10/2004 | |
| KR | 10-2016-0046715 | 4/2016 | |

OTHER PUBLICATIONS

Attached pdf file is translation of foreign reference 854771 (Year: 1960).*
International Search Report (with English Translation) and Written Opinion dated Nov. 30, 2017 issued in Application No. PCT/KR2017/008513.
Korean Office Action issued in Application No. KR 10-2016-0117506 dated Mar. 21, 2018.
Korean Office Action issued in Application No. KR 10-2016-0117506 dated Oct. 15, 2018.

* cited by examiner

EVAPORATOR AND REFRIGERATOR HAVING SAME

CROSS-REFERENCE TO RELATED PATENT APPLICATIONS

This application is a U.S. National Stage Application under 35 U.S.C. § 371 of PCT Application No. PCT/KR2017/008513, filed Aug. 7, 2017, which claims priority to Korean Patent Application No. 10-2016-0117506, filed Sep. 12, 2016, whose entire disclosures are hereby incorporated by reference.

FIELD

The present disclosure relates to an evaporator having a defrosting device for removing deposited frost, and a refrigerator having the same.

BACKGROUND

The refrigerator is a device for keeping food stored in the refrigerator at low temperatures using cold air generated by a refrigerating cycle in which a process of compression, condensation, expansion, and evaporation is continuously performed.

A refrigerating cycle in a refrigerating chamber (or refrigerating compartment) includes a compressor compressing a refrigerant, a condenser condensing the refrigerant in a high-temperature and high-pressure state compressed by the compressor through heat dissipation, and an evaporator cooling ambient air according to a cooling operation of absorbing ambient latent heat as the refrigerant provided from the condenser is evaporated. A capillary or an expansion valve is provided between the condenser and the evaporator to increase a flow rate of the refrigerant and lower pressure so that the refrigerant flowing to the evaporator may easily be evaporated.

A cooling method of the refrigerator may be divided into an indirect cooling method and a direct cooling method.

The indirect cooling method is a method of cooling the inside of a storage chamber by forcibly circulating cold air generated by the evaporator using a blow fan. Generally, the indirect cooling method is applied to a structure in which a cooler chamber in which an evaporator is installed and a storage chamber in which food is stored are separated from each other.

The direct cooling method is a method in which the inside of a storage chamber is cooled by natural convection of cold air generated by an evaporator. The direct cooling method is largely applied to a structure in which an evaporator is formed in an empty box form to form a storage chamber in which food is stored.

Generally, a direct cooling type refrigerator employs a roll-bond type evaporator in which two case sheets with a pattern portion interposed therebetween are pressure-welded, high pressure air is blown into the compressed pattern portion to discharge the pattern portion, and a portion where the pattern portion was present is expanded to form a cooling flow path in which a refrigerant flows between the two pressure-welded case sheets.

Meanwhile, a difference in relative humidity between a surface of the evaporator and ambient air may cause moisture to be condensed to develop to frost on the surface of the evaporator. The frost deposited on the surface of the evaporator acts as a factor to degrade heat exchange efficiency of the evaporator.

In general, in the case of the direct cooling type refrigerator provided with a roll-bond type evaporator, a method of performing natural defrosting for a predetermined time after the compressor is forcibly turned off is used to remove frost. Such natural defrosting method causes user inconvenience and is difficult to ensure freshness of food due to a long defrosting time.

As a technique for solving such a problem, United Kingdom Patent Laid-Open Publication No. 854771 (published on Nov. 23, 1960) discloses a structure in which a tube for transmitting heat is formed to surround an evaporator case. In this structure, a working fluid contained in a water storage tank is heated by a heater and moves along the pipe, thereby melting frost deposited in the evaporator case to remove it.

However, this technique has a fundamental problem that since the tube is installed in the evaporator case, contact resistance between the tube and the evaporator case is too large to exhibit a defrosting effect. Further, since a water storage tank and the heater are provided separately from the evaporator, a total volume of the evaporator including a defrosting device (including the water storage tank, the heater, and the tube) becomes large, making it difficult to secure capacity of a freezing chamber.

In order to solve this problem, our company has developed a defrosting device configured such that a heating tube is formed in an evaporator case and a heater is adhered to the evaporator case corresponding to the heating tube to heat a working fluid in the heating tube.

Meanwhile, in the above-described related art, since a heat generating unit (including a heater and a water storage tank) is provided separately from the evaporator case, the structure of the heat generating unit does not significantly affect defrost performance. However, since the defrosting device developed by our company has a structure in which the heating tube is embedded in the evaporator case, defrosting performance varies depending on the shape of the heating tube and the heater, and thus, a structural design is required to optimize it.

The above references are incorporated by reference herein where appropriate for appropriate teachings of additional or alternative details, features and/or technical background.

SUMMARY

A first object of the present disclosure provides various modifications of a heater attachment part or a heating chamber and a flow path portion or a portion of a heating tube connected to the heater attachment part in consideration of the fact that it is difficult to, in terms of design, form an inlet and an outlet abreast which are respectively connected to both end portions of a flow path portion on one side of a heater attachment part in a structure in which a heating tube is embedded in an evaporator case.

A second object of the present disclosure provides a design condition for a heater attachment part to which a heater may be attached.

A third object of the present disclosure provides a structure for arranging a heater attachment part and a flow path portion capable of imparting directionality to a working fluid in consideration of circulation of the working fluid.

A fourth object of the present disclosure provides a structure in which a heater is prevented from overheating in consideration of the fact that the heater is attached to a heater attachment part so that a working fluid is (re)heated.

In order to achieve the first object of the present disclosure, there is provided an evaporator including: an evaporator case or a case having a box shape in which both sides are open as mutually coupled first and second case sheets or inner and outer layers are bent, and forming a storage space of food therein; a cooling tube remaining as an empty space or formed in a first channel between the first and second case sheets and forming a cooling flow path or cooling circulation path in which a refrigerant flows; a heating tube remaining as an empty space or formed in a second channel between the first and second case sheets not to overlap the cooling tube and forming a heating flow path or a heating circulation path in which a working fluid or a second refrigerant for defrosting flows; and a heater attached to an outer surface of the evaporator case corresponding to the heating tube and heating the working fluid in the heating tube, wherein the heating tube includes a heater attachment part to which the heater is attached to heat the working fluid therein and having an outlet through which the working fluid heated by the heater is discharged and an inlet through which the cooled working fluid returns, the outlet and the inlet being provided on both sides of the heater attachment part; and a flow path portion or a portion of the heating tube adjacent to the heater attachment part having both end portions respectively connected to the outlet and the inlet to form a flow path through which the working liquid circulates.

The heater attachment part may be formed on a lower surface of the evaporator case.

The heater may be attached to the bottom of a lower surface of the evaporator case corresponding to the heater attachment part.

In order to achieve the first object of the present disclosure, there is also provided an evaporator including; an evaporator case having a box shape in which both sides are open as mutually coupled first and second case sheets are bent, and forming a storage space of food therein; a cooling tube remaining as an empty space between the first and second case sheets and forming a cooling flow path in which a refrigerant flows; a heating tube remaining as an empty space between the first and second case sheets not to overlap the cooling tube and forming a heating flow path in which a working fluid for defrosting flows; and a heater attached to an outer surface of the evaporator case corresponding to the heating tube and heating the working fluid in the heating tube, wherein the heating tube includes a heater attachment part to which the heater is attached to heat the working fluid therein and having an opening formed on one side thereof to allow the working fluid heated by the heater to be discharged and cooled working fluid to be returned therethrough; and a flow path portion communicating with the opening and forming a flow path through which the working liquid circulates.

The heater attachment part may be formed on a lower surface of the evaporator case and provided adjacent to one side surface, and the flow path portion communicating with the opening may extend to the one side surface to form circulation flow by a lifting force of the heated working fluid.

The heater attachment part may be provided to be or extend in a direction perpendicular with respect to the flow path portion.

The second object may be achieved by forming the heater attachment part to have a width of 10 mm to 12 mm.

Here, a length of the heater attachment part may be 47 mm to 80 mm.

In order to achieve the third object of the present disclosure, the heater attachment part may be provided adjacent to one side surface of the evaporator case, and the flow path portion connected to the outlet may extend to the one side surface.

In order to achieve the fourth object of the present disclosure, the flow path portion may include at least one of a first bent portion or a first bend formed at a portion adjacent to the outlet to change a flow direction of the working fluid discharged from the outlet; and a second bent portion or a second bend formed at a portion adjacent to the inlet and changing a flow direction of the working fluid to allow the working fluid to flow into the inlet.

The heater attachment part may include an extension region extending to have the same width as that of the flow path portion; and an expansion region formed at least on one side of the extension region and expanding the width of the extension region.

Or, the heater attachment part may include: a first portion having the outlet; a second portion connected in the form of being bent from the first portion; and a third portion connected in the form of being bent from the second portion, provided to be parallel to the first portion, and having the inlet.

Here, the first portion is connected in the form of being bent to one end portion of the flow path portion and the third portion may be connected in the form of being bent to the other end portion of the flow path portion.

The heater may include: a first heater portion provided to cover the first portion; a second heater portion connected in the form of being bent from the first heater portion and provided to cover the second portion; and a third heater portion connected in the form of being bent from the second heater portion, provided to cover the third portion, and provided to be parallel to the first heater portion.

The effect of the present invention obtained through the above-described solution is as follows.

First, as an example of the heating tube, a structure in which an inlet and an outlet are formed on both sides of the heater attachment part and both end portions of the flow path portion are connected to the inlet and the outlet, respectively, may be proposed. Alternatively, as another example of the heating tube, a structure in which an opening is formed at one side of the heater attachment part, a working fluid heated by the heater is discharged through the opening, and the cooled working fluid is returned through the opening may be proposed. According to the above-described structures, it is possible to constitute a heating flow path in which the working fluid may circulate, without forming an inlet and an outlet connected to both end portions of the flow path portion in parallel on one side of the heater attachment part.

Second, when the heater attachment part is formed to have a width of 8 mm to 12 mm including the thickness of the rounded edge portion, a flat portion may be formed without swelling or breaking of the heater attachment part, and a surface heater having a width of 8 mm may be completely in surface contact with the heater attachment part.

Third, the heater attachment part formed on the lower surface of the evaporator case is provided adjacent to or near one side surface of the evaporator case and the flow path portion connected to the outlet of the heater attachment part extends to one side, a circulating flow may be formed by a lifting force of the heated working fluid.

Fourth, since the flow path portion connected to the outlet of the heater attachment part has a bent shape, a certain amount of the working liquid may gather in the heater attachment part, so that overheating of the heater may be prevented. Further, since the flow path portion connected to the inlet of the heater attachment part has a bent shape, flow resistance may be formed to limit backflow of the heater.

BRIEF DESCRIPTION OF THE DRAWINGS

The embodiments will be described in detail with reference to the following drawings in which like reference numerals refer to like elements wherein.

DETAILED DESCRIPTION

Figure 1:
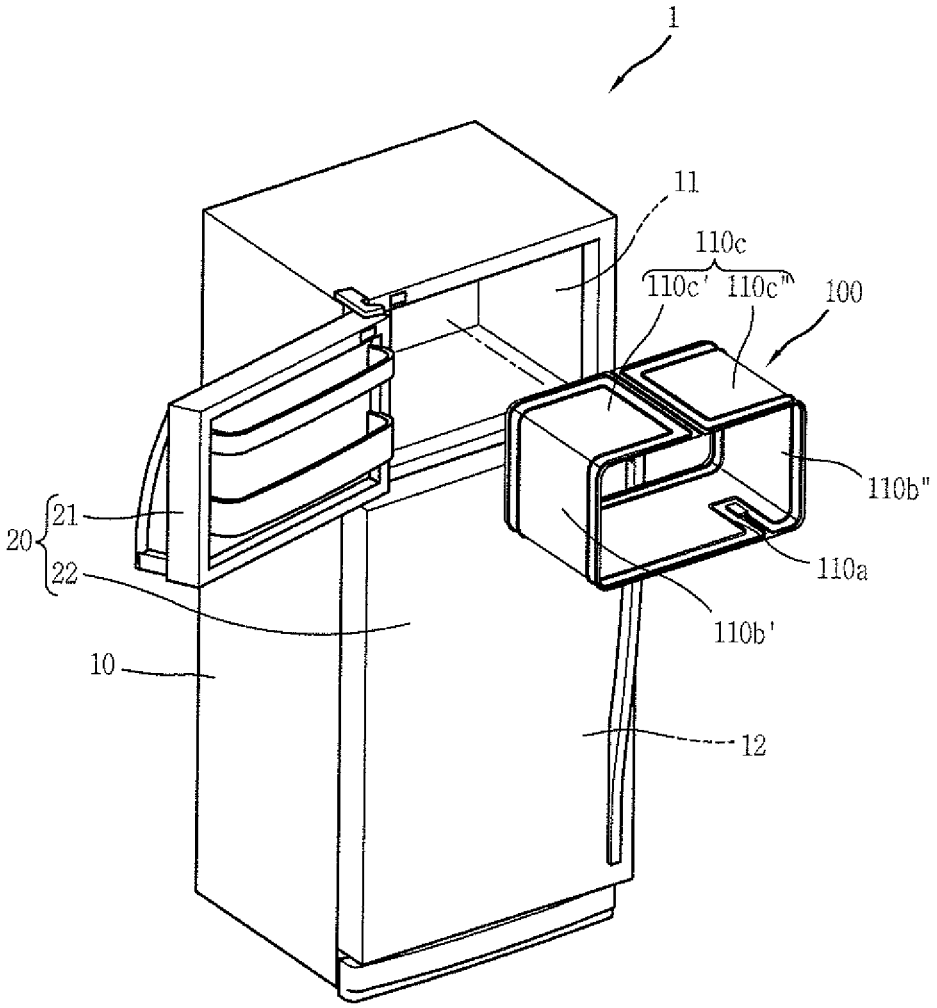
FIG. 1 is a conceptual view illustrating a refrigerator according to an embodiment of the present disclosure.

Hereinafter, an evaporator and a refrigerator having the evaporator according to the present disclosure will be described in detail with reference to the accompanying drawings.

In the present disclosure, the same reference numerals are given to the same or similar components in the different embodiments, and a redundant description thereof will be omitted.

In addition, the structure applied to any one embodiment may be applied in the same manner to another embodiment as long as the different embodiments are not structurally and functionally inconsistent.

As used herein, the singular forms "a", "an" and "the" are intended to include the plural forms as well, unless the context clearly indicates otherwise.

In the following description, when the detailed description of the relevant known function or configuration is determined to unnecessarily obscure the important point of the present disclosure, the detailed description will be omitted.

The accompanying drawings of the present disclosure aim to facilitate understanding of the present disclosure and should not be construed as limited to the accompanying drawings. Also, the present disclosure is not limited to a specific disclosed form, but includes all modifications, equivalents, and substitutions without departing from the scope and spirit of the present disclosure.

FIG. 1 is a conceptual view illustrating a refrigerator 1 according to an embodiment of the present disclosure.

The refrigerator 1 is a device for keeping food stored therein at low temperatures using cold air generated by a refrigerating cycle in which a process of compression, condensation, expansion, and evaporation is continuously performed.

As illustrated, a cabinet 10 has a storage space for storing food therein. The storage space may be separated by a partition wall and may be divided into a freezing chamber (or a freezing compartment) 11 and a refrigerating chamber (or a refrigerating compartment) 12 according to set temperatures.

In the present embodiment, a top mount type refrigerator in which the freezing chamber 11 is provided on the refrigerating chamber 12 is illustrated, but the present disclosure is not limited thereto. The present disclosure is also applicable to a side-by-side type refrigerator in which a freezing chamber and a refrigerating chamber are provided on the left and right, and a bottom freezer type refrigerator in which a refrigerating chamber is provided at an upper portion thereof and a freezing chamber is provided at a lower portion thereof.

A door 20 is connected to the cabinet 10 to open and close a front opening of the cabinet 10. In the figure, a freezing chamber door 21 and a refrigerating chamber door 22 are configured to open and close the front openings of the freezing chamber 11 and the refrigerating chamber 12, respectively. The door 20 may be variously configured as a rotatable door rotatably connected to the cabinet 10, a drawer-type door slidably connected to the cabinet 10, and the like.

A machine chamber (not illustrated) is provided in the cabinet 10, and a compressor, a condenser, and the like, are provided in the machine chamber. The compressor and the condenser are connected to the evaporator 100 to constitute a refrigerating cycle.

Meanwhile, a refrigerant R circulating in the refrigerating cycle absorbs ambient heat in the evaporator 100 as evaporation heat, thereby obtaining a cooling effect in the periphery. In this process, when a temperature difference with ambient air occurs, moisture in the air is condensed and frozen on the surface of the evaporator 100, that is, frost is deposited thereon. Frost deposited on the surface of the evaporator 100 acts as a factor to lower the heat exchange efficiency of the evaporator 100.

As described above in the background of the present disclosure, in the case of a direct cooling type refrigerator, the structure in which a tube for transmitting heat is formed to enclose an evaporator in order to remove frost deposited on the evaporator. However, this structure has problems that heat exchange efficiency is low due to the occurrence of heat loss, capacity of a freezing chamber is reduced due to a defrosting device which occupies a volume.

Thus, the present disclosure proposes a new type of evaporator 100 that may solve the above problems.

Figure 2:
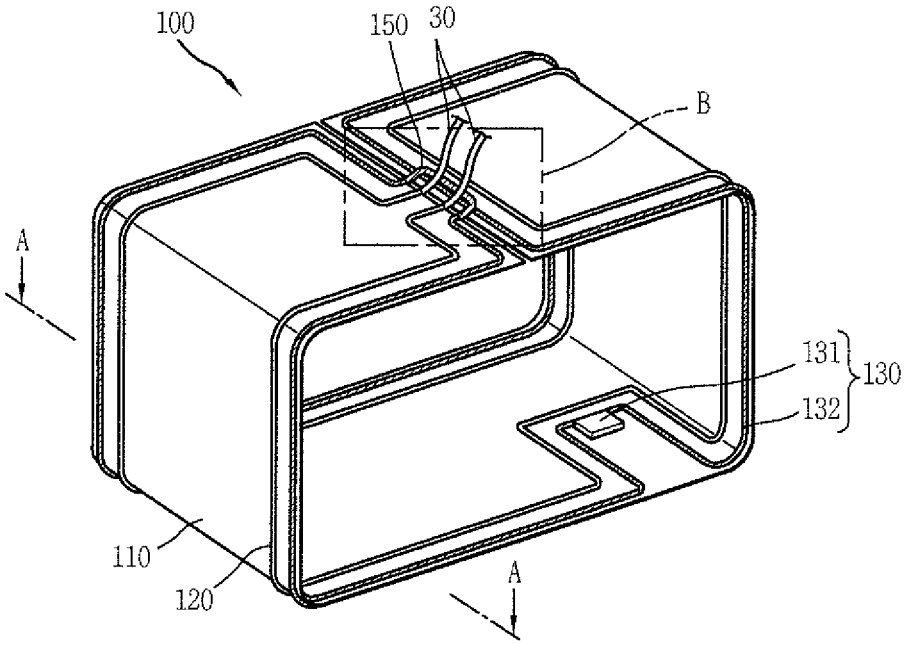
FIGS. 2 and 3 are conceptual views of a first embodiment of an evaporator applied to the refrigerator of FIG. 1, viewed from different directions.
Figure 3:
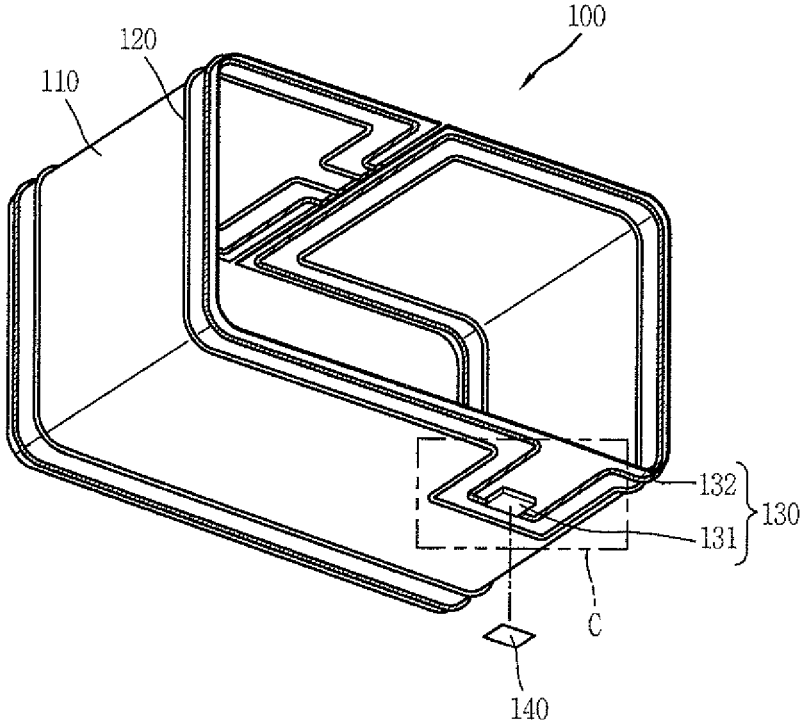
Figure 4:
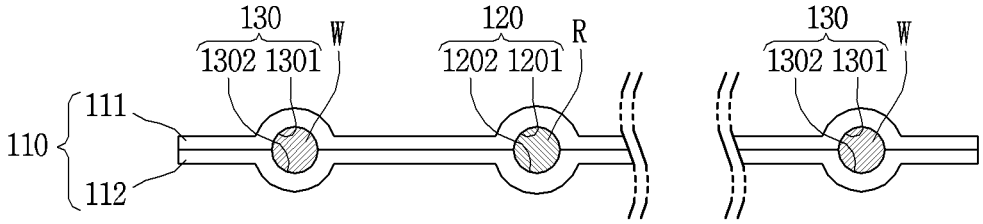
FIG. 4 is a cross-sectional view of the evaporator illustrated in FIG. 2 taken along line A-A.
Figure 5:
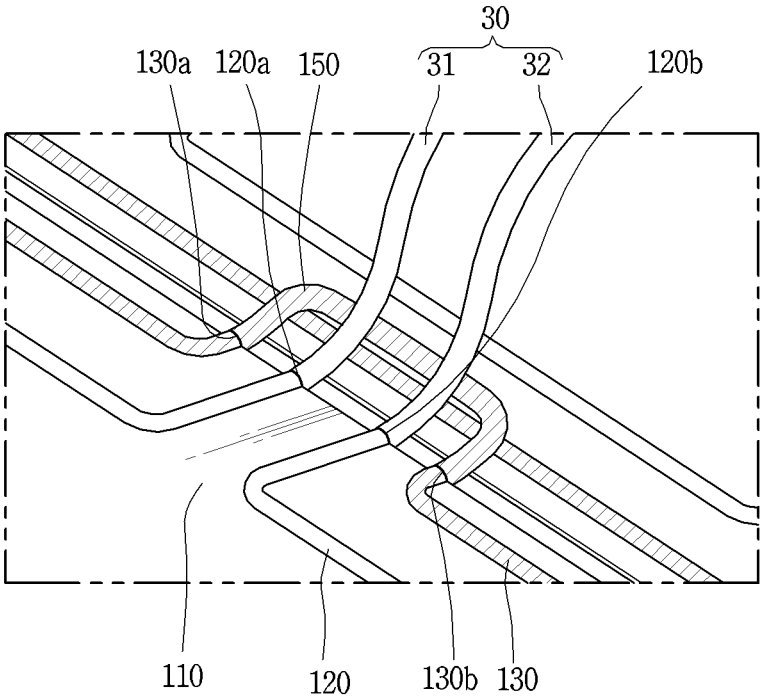
FIG. 5 is an enlarged view of a portion B illustrated in FIG. 2.

FIGS. 2 and 3 are conceptual views illustrating a first embodiment of the evaporator 100 applied to the refrigerator 1 of FIG. 1 viewed from different directions, FIG. 4 is a cross-sectional view of the evaporator 100 illustrated in FIG. 2, taken along line A-A, and FIG. 5 is an enlarged view of a portion 'B' of FIG. 2.

Referring to FIGS. 2 to 5, the evaporator 100 of the present disclosure includes an evaporator case 110, a cooling tube or first channel 120, a heating tube or second channel 130, and a heater 140. Among the components of the evaporator 100, the cooling tube 120 is a component for cooling and the heating tube 130 and the heater 140 are components for defrosting. Referring to FIG. 4, the first channel 120 (or cooling tube) comprises at least one first groove 1201 formed in the first case sheet 111 and at least one second groove 1202 formed in the second case sheet 112, and the second channel 130 (or heating tube) comprises at least one third groove 1301 formed in the first case sheet 111 and at least one fourth groove 1302 formed in the second case sheet 112, such that when the first and second sheets 111 and 112 are coupled to each other, at least one first groove 1201 and at least one second groove 1202 align with each other to form the cooling tube 120, and at least one third groove 1301 and at least one fourth groove 1302 align with each other to form the heating tube 130.

The evaporator case 110 is formed by bending a plate-shaped frame in which first and second case sheets or inner and outer layers 111 and 112 are coupled to each other, in the form of an empty box. The evaporator case 110 may be formed in a rectangular box shape opened forwards and backwards.

The evaporator case 110 itself may form a storage chamber for storing food therein or may be formed to enclose a separately provided housing (not illustrated).

The evaporator case 110 is provided with a cooling tube 120 through which a refrigerant R for cooling flows and a heating tube 130 through which a working fluid or a second refrigerant W for defrosting flows. The cooling tube 120 and the heating tube 130 may be formed on at least one surface of the evaporator case 110 and include a cooling flow path or cooling circulation path through which the refrigerant R may flow and a heating flow path or a heating circulation path through which the working fluid W may flow, respectively.

The cooling tube 120 and the heating tube 130 may be formed in a predetermined pattern on the evaporator case 110 and may be configured not to overlap each other so that the refrigerant R flowing through the cooling tube 120 and the working fluid W flowing through the heating tube 130 may have separate flow paths (cooling flow path heating flow path), respectively.

In the first embodiment, it is illustrated that the heating tube 130 is formed to surround or enclose at least a portion of the cooling tube 120. That is, a cooling flow path formed by the cooling tube 120 is formed in the heating flow path in the form of a loop formed by the heating tube 130. For reference, in the first embodiment, the cooling tube 120 and the heating tube 130 are only illustrated briefly for convenience of explanation, and actually, the components may have various forms.

A method of manufacturing the evaporator case 110 in which the cooling tube 120 and the heating tube 130 are formed will be described.

First, a first case sheet 111 and a second case sheet 112 which are to be the materials of the evaporator case 110 are prepared. The first and second case sheets 111 and 112 may be formed of a metal (e.g., aluminum or steel, etc.) and a coating layer may be formed on a surface of the first and second case sheets 111 and 112 to prevent corrosion due to contact with moisture.

A first pattern portion (not shown) corresponding to the cooling tube 120 and a second pattern portion (not shown) corresponding to the heating tube 130 are provided on the first case sheet 111. A first pattern portion (not shown) corresponding to the cooling tube 120 and a second pattern portion (not shown) corresponding to the heating tube 130 are arranged on the first case sheet 111. The first and second pattern portions are patterned such that they do not intersect each other or do not to overlap each other. The first and second pattern portions are removed later and may be formed of a graphite material provided in a preset pattern.

Each of the first and second pattern units or portions may be formed to continue without a disconnection and may be bent in at least at a portion. Each of the first and second pattern units may extend from a first corner of the first case sheet 111 to a second corner thereof. The first corner where the first and second pattern portions start and the second corner where the first and second pattern portions end may be the same corners or may be different corners.

Next, the first and second case sheets 111 and 112 are brought into contact with each other with the first and second pattern portions sandwiched therebetween, and then the first and second case sheets 111 and 112 are pressed and integrated with each other.

Then, a plate-shaped frame in which the first and second case sheets 111 and 112 are integrated is formed in which the first and second pattern portions are located. In this state, high-pressure air is sprayed to the first and second pattern portions exposed to the outside through one side of the frame corresponding to the first corner.

The first and second pattern portions existing between the first and second case sheets 111 and 112 are discharged from the frame by the sprayed high-pressure air. In this process, a space or a groove in which the first pattern portion was present is left as an empty space or channel to form the cooling tube 120, and a space in which the second pattern portion was present is left as an empty space or channel to form the heating tube 130.

In the process of discharging the pattern portion by spraying the high-pressure air, the portions where the first and second pattern portions were present are expanded to be larger than a volume of the first and second pattern portions. Accordingly, the expanded portions of the first and second pattern portions form the cooling tube 120 through which the refrigerant R may flow and the heating tube 130 through which the working fluid W may flow, respectively.

According to the manufacturing method, the cooling tube 120 and the heating tube 130 protruding from at least on one side are formed on the frame. For example, when the first and second case sheets 111 and 112 have the same rigidity, the cooling tube 120 and the heating tube 130 protrude from both sides of the frame. In another example, when the first case sheet 111 has rigidity higher than that of the second case sheet 112, the cooling tube 120 and the heating tube 130 may protrude from the second case sheet 112, while the first case sheet 111 having relatively high rigidity may be maintained to be flat.

The integrated plate-shaped frame is bent and manufactured as a hollow box-shaped evaporator case 110 as illustrated. For example, referring to FIG. 1 together, the evaporator case 110 may have a rectangular box shape with both sides open, including a lower surface 110*a*, a left side surface 110*b*' and a right side surface 110*b*" extending to both sides from the lower surface 110*a*, and a left side upper surface 110*c*' and a right side upper surface 110*c*" extending from the left side surface 110*b*' and the right side surface 110*b*" to be parallel to the lower surface 110*a*.

The cooling tube 120 formed in the evaporator case 110 is connected to a condenser and a compressor through an extension pipe 30, whereby a refrigerating cycle is formed. The extension pipe 30 may be connected to the cooling tube 120 by welding.

Specifically, one end (inlet 120*a*) of the cooling tube 120 is connected to one end 31 of the extension tube 30 and the other end (outlet 120*b*) of the cooling tube 120 is connected to the other end of the extension tube 30, forming a circulation loop of the refrigerant R. The refrigerant R which has a low temperature and low pressure and is in a liquid state flows in through the one end 120*a* of the cooling tube 120 and the refrigerant R which is in a gaseous state flows out through the other end 120*b* of the cooling tube 120.

According to the above structure, the cooling tube 120 is filled with the refrigerant R for cooling, and the evaporator case 110 and ambient air of the evaporator case 110 are cooled according to circulation of the refrigerant R. The refrigerant R may be injected into the cooling tube 120 before the extension pipe 30 is welded to the cooling tube 120.

In addition, the heating tube 130 formed in the evaporator case 110 is filled with the working fluid W for defrosting. To this end, in the first embodiment, it is illustrated that first and second openings or ends 130*a* and 130*b* of the heating tube 130 are exposed to one end portion of the frame. However, the present disclosure is not limited thereto. The first and second openings 130*a* and 130*b* of the heating tube 130 may be portions exposed to the outside when a predetermined portion is cut at a specific position of the frame.

The working fluid W is filled in the heating tube 130 through at least one of the first and second openings 130*a* and 130*b* and, after the working fluid W is filled, the first and second openings 130*a* and 130*b* may communicate with each other through a connection pipe 150. The connection pipe 150 may be sealed or welded to the heating tube 130 after the working fluid W is injected into the heating tube 130.

In the example of FIG. 5, it is illustrated that the first and second openings 130*a* and 130*b* of the heating tube 130 are mutually connected by the connection pipe 150, whereby the heating tube 130 forms a closed-loop circulation flow path with the connection pipe 150 to allow the working fluid W to circulate therealong. The connection pipe 150 may be connected to the first and second openings 130*a* and 130*b* by welding.

As the working fluid W, a refrigerant (e.g., R-134*a*, R-134*a*, etc.) which exists in a liquid phase under a freezing condition of the refrigerator 1 and which is changed to a gaseous phase to serve to transport heat may be used.

A charging amount of the working fluid W must be appropriately selected in consideration of a heat radiation temperature according to the charging quantity as compared with a total volume of the heating tube 130 and the connection pipe 150. According to experimental results, it is preferable that the working fluid W is filled with 80% or greater and less than 100% of the total volume of the heating tube 130 and the connection pipe 150 with respect to a liquid state. If the working fluid W is filled with less than 80%, the heating tube 130 may overheated, and if the working fluid W is filled with 100%, the working fluid W may not circulate smoothly.

Referring back to FIG. 3, the heater 140 is adhered to an outer surface of the evaporator case 110 corresponding to the heating tube 130 to heat the working fluid Win the heating tube 130. In the first embodiment, it is illustrated that the heater 140 is adhered to a lower portion of the lower surface 110*a* of the evaporator case 110 to cover a heater attachment part or a heating chamber 131.

The heater 140 is electrically connected to a controller (not illustrated) and generates heat when a driving signal is received from the controller. For example, the controller may be configured to apply a driving signal to the heater 140 at predetermined time intervals.

As described above, according to the present invention, the evaporator 100 having a novel structure in which the cooling tube 120 and the heating tube 130 are formed in the evaporator case 110 in a roll-bond type and the cooling tube 120 is filled with the refrigerant R and the heating tube is filled with the working liquid W may be provided. According to the present invention, a defrost time is reduced compared with existing natural defrosting, keeping freshness of the food, and cooling efficiency, which was decreased due to frost, is increased to reduce power consumption.

Further, since the heating tube 130 is embedded in the evaporator case 110, defrost heat may be more efficiently used for defrosting than the conventional structure. Also, since a substantial space is not required for forming the defrosting device, capacity of the freezing chamber 11 may be maximized.

Hereinafter, the structure of the evaporator 100 related to defrosting will be described in more detail.

Figure 6:
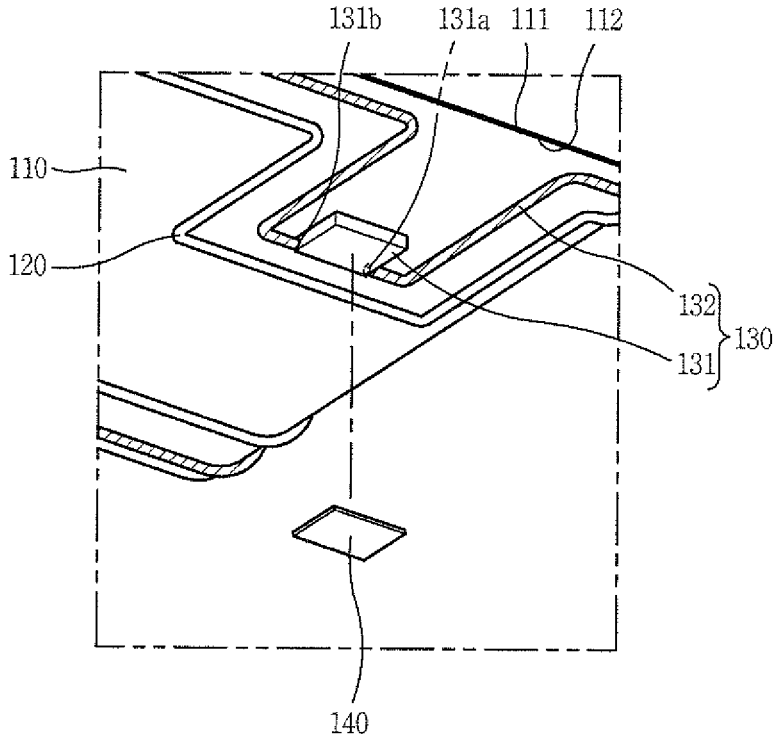
FIG. 6 is an enlarged view of a portion C (first embodiment of heating tube) illustrated in FIG. 3.

FIG. 6 is an enlarged view of a portion C (first embodiment of the heating tube 130) illustrated in FIG. 3.

Referring to FIG. 6 together with the forgoing figures, the heating tube 130 is formed in a predetermined pattern in the evaporator case 110 and does not overlap the cooling tube 120. The inside of the heating tube 130 is filled with the working fluid W for defrosting. The heating tube 130 includes a heater attachment part or a heating chamber 131 and a flow path portion 132, or a portion of the heating tube 130 that connects to or is adjacent to the heating chamber 131. The heating chamber 131 (or the fluid chamber) is provided by a space formed between the first and second case sheets (or the inner and outer layers 111 and 112).

The heater attachment part 131 is formed as an empty space having a predetermined volume so that a predetermined amount of the working fluid W may be filled therein. The heater 140 is attached to the heater attachment part 131 to heat the working fluid W therein.

As described above, the heater attachment part 131, which is a component of the heating tube 130, is formed by the first case sheet 111 and the second case sheet 112 constituting the evaporator case 110. That is, the inner space of the heater attachment part 131 is defined as an inner space defined by the first case sheet 111 and the second case sheet 112.

An outlet 131*a* through which the working fluid W heated by the heater 140 is discharged and an inlet 131*b* through which the working fluid W cooled while flowing through the flow path portion 132 returns are formed on both sides of the heater attachment part 131. In this figure, the heater attachment part 131 is formed to extend in one direction, and the outlet 131*a* and the inlet 131*b* are formed on both sides thereof in a longitudinal direction.

The heater attachment part 131 may be formed at a lower portion of the evaporator case 110. For example, as illustrated, the heater attachment part 131 may be formed on the lower surface 110*a* of the evaporator case 110. In another example, the heater attachment part 131 may be formed at a lower portion of the left side surface 110*b*' of the evaporator case 110 or at a lower portion of the right side surface 110*b*" thereof.

The heater 140 is attached to an outer surface of the evaporator case 110 corresponding to the heater attachment part 131 to heat the working liquid W in the heating tube 130. In this embodiment, the heater 140 is attached to the bottom of the lower surface of the evaporator case 110 to cover the heater attachment part 131 to heat the working fluid W in the heater attachment part 131.

The structure in which the heater 140 is attached to the bottom of the lower surface of the evaporator case 110 is advantageous in that an upward driving force is generated in the heated working fluid W, and since defrost water generated due to defrosting does not directly fall to the heater 140, a short may be prevented.

Actuation and unactuation of the heater 140 may be controlled by time, temperature conditions, and the like. For example, actuation of the heater 140 is controlled by a time condition, and unactuation of the heater 140 may be controlled by a temperature condition.

Specifically, the controller may be configured to stop the actuation of the compressor and supply power to the heater 140 when a certain period of time has lapsed after the compressor constituting the refrigerating cycle together with the evaporator 100 is actuated. That is, the heater 140 generates heat upon receiving power at every predetermined time.

In addition, when a temperature detected by a defrost sensor (not shown) reaches a predetermined defrost termination temperature, the controller may stop supplying power to the heater 140. Since power is not supplied to the heater 140, active heat generation of the heater 140 is stopped and the temperature is gradually lowered.

For reference, since the heater 140 as a heat source is provided to correspond to the heater attachment part 131, the heater attachment part 131 has the highest temperature in the heating tube 130. Therefore, when the heater attachment part 131 is formed on the lower surface 110*a* of the evaporator case 110 as in the above example, frost deposited on the evaporator 100 may be effectively removed by convection lift due to heat and heat transfer to the left and right side surfaces 110*b*' and 110*b*" of the evaporator case 110.

Further, most of the working fluid W gathers to a lower portion of the evaporator case 110 by gravity. Therefore, when the heater attachment part 131 is formed at the lower portion of the evaporator case 110, the heater attachment part 131 is kept filled with the working fluid W, and thus, the heater attachment part 131 is prevented from being overheated.

Also, in order to effectively use high temperature heat at the heater 140 and the heater attachment part 131, the heater attachment part 131 may be formed at a position spaced inwards from the edge of the evaporator case 110. Alternatively, the heater attachment part 131 may extend inwards toward the cooling tube 120 formed in the loop-shaped heating flow path.

Both ends of the flow path portion 132 are connected to the outlet 131*a* and the inlet 131*b* of the heater attachment part 131 to form a flow path through which the working fluid W circulates.

The flow path portion 132 is formed by the first case sheet 111 and the second case sheet 112 constituting the evaporator case 110 like the heater attachment part 131. That is, an internal space of the flow path portion 132 is defined as an internal space defined by the first case sheet 111 and the second case sheet 112.

In order to form circulation flow by a lifting force of the heated working fluid W, the heater attachment part 131 is provided adjacent to one side surface of the evaporator case 110, and the flow path portion 132 connected to the outlet 131*a* of the heater attachment part 131 may extend upwards from the evaporator case 110.

Referring to FIGS. 2 and 3, the heater attachment part 131 formed on the lower surface of the evaporator case 110 may be provided adjacent to one side surface of the evaporator case 110.

Both end portions of the flow path portion 132 are connected to the outlet 131*a* and the inlet 131*b* of the heater attachment part 131, respectively. The flow path portion 132 connected to the outlet 131*a* extends to one side surface among the left and right side surfaces 110*b*' and 110*b*" of the evaporator case 110 and continue to extend toward the upper surface 110*c* of the evaporator case 110. The flow path portion 132 connected to the inlet 131*b* may extend to the other side among the left and right side surfaces 110*b*' and 110*b*" of the evaporator case 110 and may continue to extend toward the upper surface 110*c* of the evaporator case 110.

Here, as illustrated, when a distance for the flow path portion 132 extending from the outlet 131*a* to reach one side among the left and right side surfaces 110*b*' and 110*b*" of the evaporator case 110 is shorter than a distance for the flow path portion 132 extending from the inlet 131*b* to reach the other side surface among the left and right side surfaces 110*b*' and 110*b*" of the evaporator case 110, the heated working liquid W may flow to the flow path portion 132 connected to the outlet 131*a*.

The working fluid W heated by the heater 140 is discharged from the outlet 131*a* of the heater attachment part 131 and flows along the flow path portion 132 to transfer heat to the evaporator case 110, and a working liquid W cooled in this process returns to the heater attachment part 131 through the inlet 131*b*, re-heated by the heater 140 and discharged from the outlet 131*a*, forming circulation flow.

In the present embodiment, it is illustrated that the heater attachment part 131 is provided adjacent to the right side surface 110*b*" of the evaporator case 110. That is, a space between the heater attachment part 131 and the right side surface 110*b*" is formed to be shorter than a space between the heater attachment part 131 and the left side surface 110*b*'. The flow path portion 132 connected to the outlet 131*a* of the heater attachment part 131 extends to the right side surface of the evaporator case 110 and the flow path portion 132 connected to the inlet 131*b* of the heater attachment part 131 extends to the left side surface of the evaporator case 110.

In the above arrangement, a length for the flow path portion 132 connected to the outlet 131*a* of the heater attachment part 131 to reach the right side surface 110*b*" of the evaporator case 110 is shorter than a length for the flow path portion 132 connected to the inlet 131*b* of the heater attachment part 131 to reach the left side surface 110*b*' of the evaporator case 110. Thus, the heated working liquid W flows to the flow path portion 132 connected to the outlet 131*a*.

The flow path portion 132 may be formed to enclose at least a portion of the cooling tube 120 formed in the evaporator case 110, and accordingly, it may extend along the inner circumference of the evaporator case 110.

In the first embodiment, the heater attachment part 131 is formed on the lower surface 110*a* of the evaporator case 110 and the flow path portion 132 extending from the outlet 131*a* extends to one side surface (right side surface 110*b*" in the drawing) of the evaporator case 110 and extends toward the upper surface (right side surface 110*c*" in the drawing) of the evaporator case 110. The working fluid W heated by the heater 140 is lifted along the heating flow path by a lifting force.

Thereafter, the flow path portion 132 passing through the one side surface 110*a* extends to the other side surface (left side surface 110*b*' in the drawing) of the evaporator case 110, extends toward the upper surface (left side upper surface 110*c*' in the drawing) of the evaporator case 110, passes through the other side surface, and extends to the lower surface 110*a* to be finally connected to the inlet 131*b* of the heater attachment part 131.

In the drawing, the cooling tube 120 is provided between the flow path portion 132 formed at the front of the evaporator case 110 and the flow path portion 132 formed at the rear of the evaporator case 110, and a flow direction of the working fluid W flowing through the flow path portion 132 formed at the front and a flow direction of the working fluid W flowing through the flow path portion 132 formed at the rear are opposite to each other.

The heater 140 is attached to the outer surface of the evaporator case 110 corresponding to the heater attachment part 131 and is configured to heat the working fluid W in the heating tube 130. The heater 140 may be formed in a plate-like shape, and typically, a plate-shaped ceramic heater 140 may be used.

Figure 7:
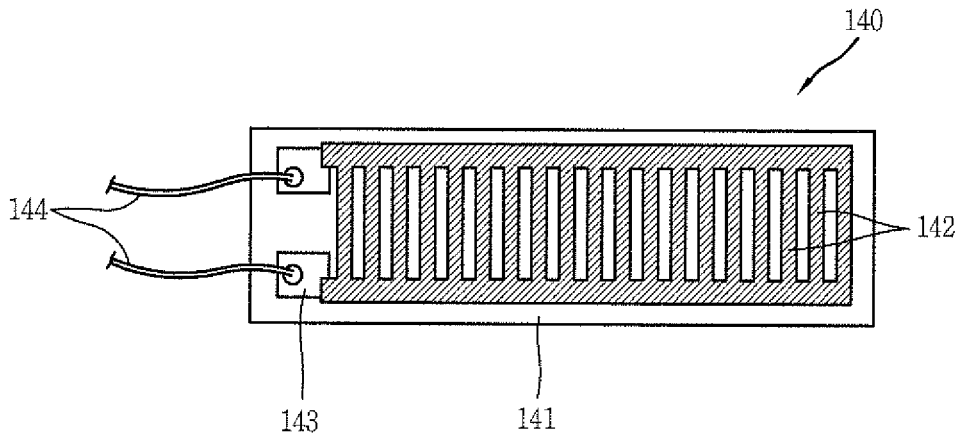
FIG. 7 is a conceptual view illustrating an example of a heater illustrated in FIG. 6.

FIG. 7 is a conceptual view illustrating an example of the heater 140 illustrated in FIG. 6.

Referring to FIG. 7, the heater 140 includes a base plate 141, a hot wire 142, and a terminal 143.

The base plate 141 is formed in a plate-like shape and attached to the heater attachment part 131. The base plate 141 may be formed of a ceramic material.

The hot wire 142 is formed on the base plate 141. The hot wire 142 generates heat when a driving signal is received from a controller. The hot wire 142 may be formed by patterning a resistor (e.g., a powder formed by combining ruthenium and platinum, tungsten, etc.) on the base plate 141 in a specific pattern.

The terminal 143 electrically connected to the hot wire 142 is provided on one side of the base plate 141, and a lead wire 144 electrically connected to the controller is connected to the terminal 143.

According to the configuration, when a driving signal is generated by the controller, the driving signal is transferred to the heater 140 through the lead wire 144, and the hot wire 142 of the heater 140 is heated according to power application. Heat generated by the heater 140 is transferred to the heater attachment part 131, whereby the working fluid W in the heater attachment part 131 is heated to a high temperature.

Meanwhile, a thermally conductive adhesive (not illustrated) may be interposed between the heater attachment part 131 and the heater 140 (specifically, between the heater attachment part 131 and the base plate 141). By the thermally conductive adhesive, the heater 140 may be more firmly fixed to the evaporator case 110 and heat transfer from the heater 140 to the heater attachment part 131 may be increased. As the thermally conductive adhesive, heat-resistant silicon which endures at high temperature may be used.

Since the heater 140 is installed in the evaporator 100, defrost water generated due to defrosting may be introduced to the heater 140 in terms of structure. Since the heater 140 included in the heater 140 is an electronic component, a short circuit may occur when defrost water comes into contact with the heater 140. Thus, in order to prevent moisture including defrost water from penetrating into the heater 140, a sealing member (not illustrated) for covering and sealing the heater 140 may be provided.

An insulating material (not illustrated) may be interposed between a rear surface of the heater 140 and the sealing member. A mica sheet formed of mica may be used as the insulating material. Since the insulating material is provided on the rear surface of the heater 140, heat transfer to the rear side of the heater 140 may be restricted when the hot wire 142 generates heat according to power application. Therefore, melting of the sealing member due to heat transfer may be prevented.

For reference, water, i.e., defrost water, removed by the defrosting device flows into a guide tray (not illustrated) below the evaporator 100 and finally flows to a defrost water trap (not illustrated) at a lower portion of the refrigerator 1 through a defrost water discharge pipe (not illustrated).

Figure 8:
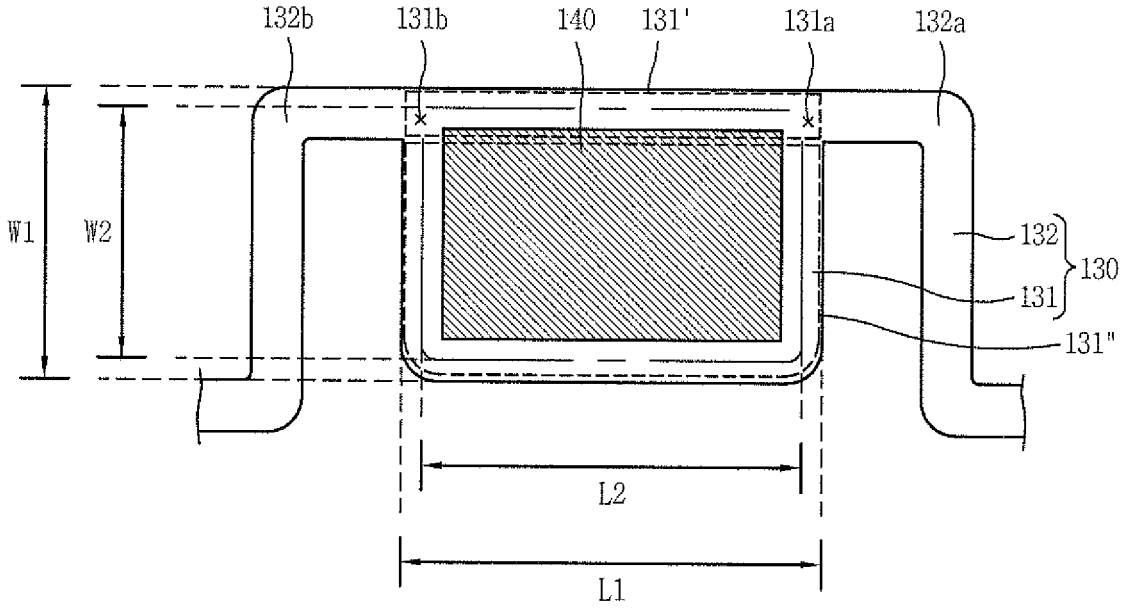
FIG. 8 is a conceptual view illustrating a state in which a heater is attached to a heater attachment part of FIG. 6.

FIG. 8 is a conceptual view illustrating a state in which the heater 140 is adhered to the heater attachment part 131 in FIG. 6.

As described above, a plate-shaped ceramic heater may be used as the heater 140. Such a plate-like ceramic heater may have a size of 8 mm (width)×45 mm (length) or 8 mm (width)×65 mm (length). In this case, with respect to a case where the evaporator 100 is viewed from the outside, a protruding region [W1 (width)×L1 (length)] where the heater attachment part 131 is formed may have a width W1 of 10 mm to 12 mm and a length L1 of 47 mm to 80 mm.

In the protruding region where the heater attachment part 131 is formed, a thickness of the rounded edge portion is approximately 1 mm, and thus, the protruding region may have a length and a width obtained by adding a thickness of 2 mm at both sides of the rounded edge portion to a length and a width of the heater 140, at the least.

Therefore, in order for the heater 140 to be completely in contact with a flat portion [W2 (width)×L2 (length)) of the protruding region, the protruding region may be set to a width of 100 mm or greater and a length of 47 mm or greater.

In a state in which the length of the protruding region is set to 47 mm or greater, if the width exceeds 12 mm, the first and second case sheets 111 and 112 may be separated or broken in the process of forming the cooling tube 120 and the heating tube 130. Also, if the length of the protruding region exceeds 80 mm, the first and second case sheets 111 and 112 may be separated or broken in the process of forming the cooling tube 120 and the heating tube 130.

Therefore, it is preferable that the protruding region is set to a width of 10 mm or greater and 12 mm or less and a length of 47 mm or greater and 80 mm or less.

Meanwhile, since the heater attachment part 131 forms a space in which a predetermined amount of the working fluid W stays and has an attachment surface to which the heater 140 is attached, the heater attachment part 131 is formed to be wider than the flow path portion 132. Specifically, the heater attachment part 131 is divided into an extension region 131' having a width corresponding to the flow path portion 132 and an expansion region 131" extending a width of the extension region 131'.

The extension region 131' is connected to both end portions of the flow path portion 132, and the outlet 131*a* and the inlet 131*b* are located in the extension regions. The expansion region 131" is formed on at least one side of the extension region 131' to extend the width of the extension region 131'. In this embodiment, the expansion region 131" is formed on one side of the extension region 131', but the present disclosure is not limited thereto. The extension region 131" may be formed on both sides of the extension region 131'.

By forming the extension region 131", the heater attachment part 131 may be filled with a certain amount of the working fluid W. Further, since the working fluid W stays, while forming a vortex, in the process of discharging the working fluid W from the wide expansion region 131" to the flow path portion 132 and in the process of receiving the working fluid W from the narrow flow path portion 132 to the wide expansion region 131", the heater attachment part 131 may be maintained always in a state being filled with the working fluid W.

The width and length of the extension region 131' and the expansion region 131" may be limited by the design conditions of the heater attachment part 131 described above.

The flow path portion 132 connected to at least one of the outlet 131*a* and the inlet 131*b* of the heater attachment part 131 may have a bent shape.

In this embodiment, both the flow path portion 132 connected to the outlet 131*a* and the flow path portion 132 connected to the inlet 131*b* have a bent portion. Specifically, the flow path portion 132 includes a first bent portion 132*a* formed at a position adjacent to the outlet 131*a* and switching a flow direction of the working fluid W discharged from the outlet 131*a* and a second bent portion 132*b* formed at a position adjacent to the inlet 131*b* and switching a flow direction of the working fluid W to allow the working fluid W to flow into the inlet 131*b*.

The working fluid W heated by the heater attachment part 131 is discharged through the outlet 131*a* and passes through the first bent portion 132*a*. Here, since the flow direction of the working fluid W is switched at the first bent portion 132*a* so that a part of the working fluid W stays, the working fluid may form a vortex in the first bent portion 132*a*.

That is, the working fluid W forming a vortex at the first bent portion 132*a* acts as a resistance interrupting flow of subsequent working fluid W which subsequently flows in, so that a part of the working fluid W stays in the heater attachment part 131. In this manner, since the entirety of the heated working fluid W is not immediately discharged but a part or portion thereof stays at the first bent portion 132*a* and the heater attachment part 131, in particular, at the heater attachment part 131 to which the heater 140 is attached, overheating of the heater 140 may be prevented.

The working fluid W cooled while passing through the flow path 132 returns to the heater attachment part 131 through the inlet 131*b* and the returning working fluid W is re-heated by the heater 140 and discharged through the outlet 131*a*, forming circulation flow. However, in some cases, a backflow may occur in which the working fluid W re-heated by the heater 140 is discharged through the inlet 131*b*.

In order to prevent the backflow, as described above, a circulation flow forming structure (structure in which the heater attachment part 131 is provided adjacent to one side of the evaporator case 110 and the flow path portion 132 connected to the outlet 131*a* of the heater attachment part 131 extends toward the upper side of the evaporator case 110) using a lifting force of the heated working fluid W is provided. In addition, since the second bent portion 132*b* that generates flow resistance is formed at the inlet 131*b* side, although the re-heated working fluid W flows toward the inlet 131*b*, it is interrupted by the working fluid W staying, while forming a vortex, at the second bent portion 132*b*, and thus, a backflow of the heated working fluid W may be limited.

Figure 9:
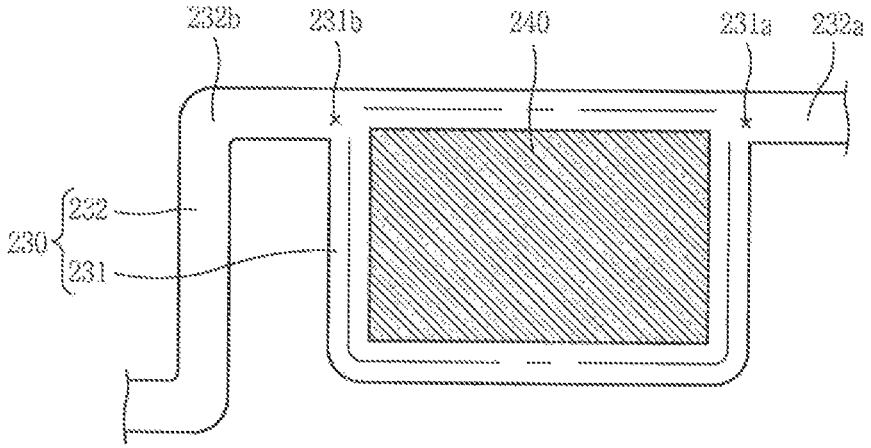
FIG. 9 is a conceptual view illustrating a first modification of the heating tube illustrated in FIG. 6.

FIG. 9 is a conceptual view illustrating a first modification of the heating tube 130 illustrated in FIG. 6.

Referring to FIG. 9, a flow path portion 232 or a portion of a heating tube 230 connected to an outlet 231*a* of a heater attachment part or a heating chamber 231 is straight without being bent, and the flow path portion 232 or a portion of the heating tube 230 connected to the inlet 231*b* of the heater attachment part 231 is bent.

Specifically, the flow path portion 232 includes a straight portion 232*a* allowing a working fluid W discharged from the outlet 231*a* to flow without changing a flow direction and a bent portion 232*b* formed at a position adjacent to the inlet 231*b* and changing a flow direction of the working fluid W to allow the working fluid W to flow into the inlet 231*b*.

The working fluid W heated by the heater attachment part 231, which is heated by a heater 240, is discharged through the outlet 231*a* so that it may be immediately discharged through the straight portion 232*a* without delay. Therefore, rapid defrosting may be achieved through rapid circulation of the working fluid W. However, in order to prevent the heater from overheating, the working fluid W may be filled in a large amount, as compared with the above embodiment.

In addition, since the bent portion 232*b* generating flow resistance at a position adjacent to the inlet 231*b* is formed, although the re-heated working fluid W flows toward the inlet 231*b*, it is interrupted by the working fluid W staying, while forming a vortex, at the bent portion 232*b*, limiting a backflow of the heated working fluid W.

Figure 10:
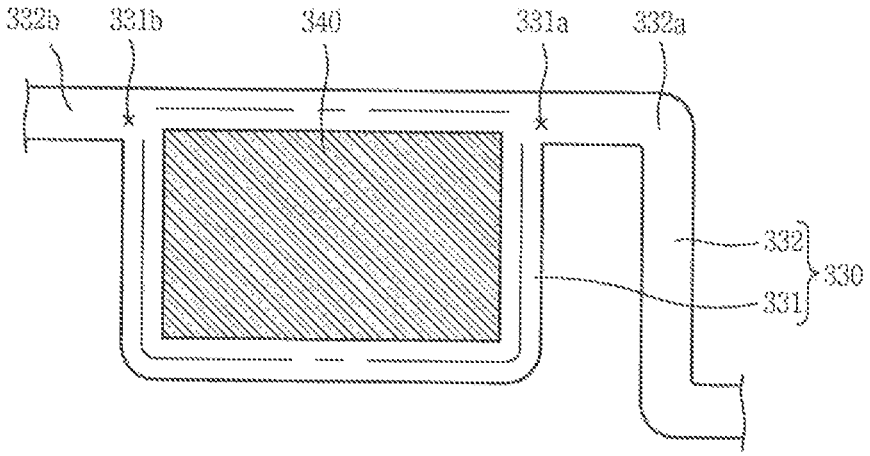
FIG. 10 is a conceptual view illustrating a second modification of the heating tube illustrated in FIG. 6.

FIG. 10 is a conceptual diagram illustrating a second modification of the heating tube 130 illustrated in FIG. 6.

Referring to FIG. 10, a flow path portion 332 or a portion of a heating tube 330 connected to an outlet 331*a* of the heater attachment part 331 is bent and the flow path portion 332 or a portion of the heating tube 330 connected to an inlet 331*b* of the heater attachment part 331 is formed to be straight, without being bent.

Specifically, the flow path portion 332 includes a bent portion 332*a* formed at a position adjacent to an outlet 331*a* and changing a flow direction of the working fluid W discharged from the outlet 331*a*, and a straight portion 332*b* allowing the working fluid W cooled, while flowing through the flow path portion 332, to flow into an inlet 331*b*, without changing the flow direction.

The working fluid W heated by the heater attachment part 331 is discharged through the outlet 331*a* and passes through the bent portion 332*a*. Here, since the flow direction of the working fluid W is changed in the bent portion 332*a*, a part of the working fluid W stays, while forming a vortex, at the bent portion 332*a*.

That is, the working fluid W staying, while forming a vortex, at the bent portion 332*a* acts as resistance which interrupts flow of the working fluid W that subsequently flows so that part of the working fluid W stays at the heater attachment part 331. In this manner, since the entirety of the heated working fluid W is not immediately discharged but part thereof stays at the first bent portion 332*a* and the heater attachment part 331, in particular, at the heater attachment part 131 to which the heater 340 is attached, overheating of the heater 340 may be prevented.

The working fluid W cooled, while flowing through the flow path portion 332, flows immediately to the inlet 331*b* through the straight portion 332*a* without delay. Here, since the working fluid W returning to the heater attachment part 331 through the inlet 331*b* is high in flow rate and fast in flow velocity, a backflow in which the working fluid W re-heated by the heater 340 is discharged through the inlet 331*b* may be limited.

Figure 11:
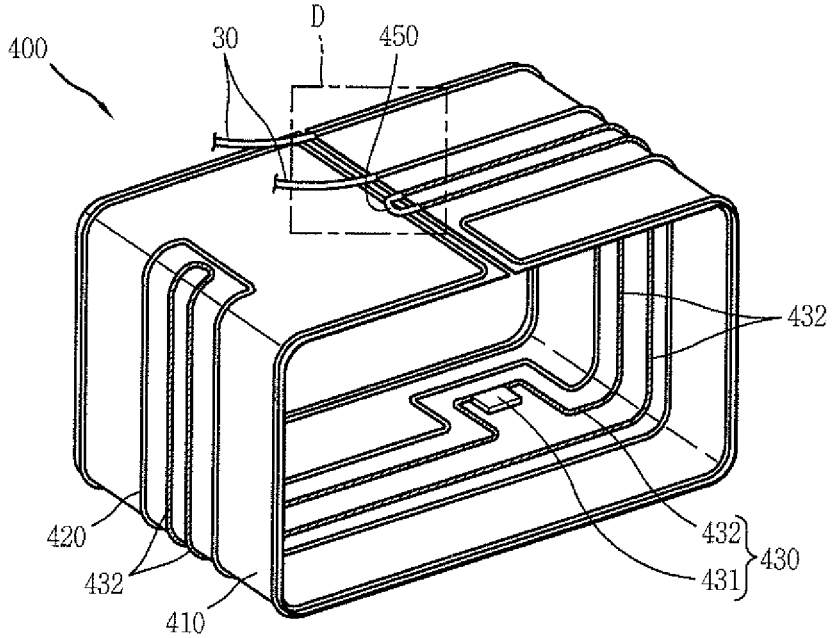
FIG. 11 and FIG. 12 are conceptual diagrams illustrating a modification of the first embodiment, viewed in different directions.
Figure 12:
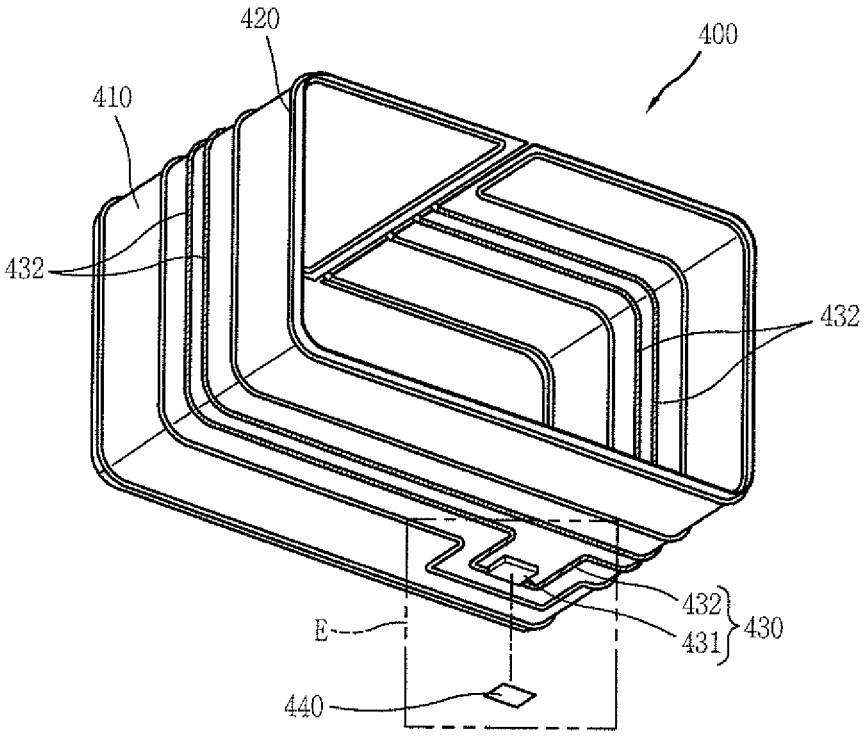
Figure 13:
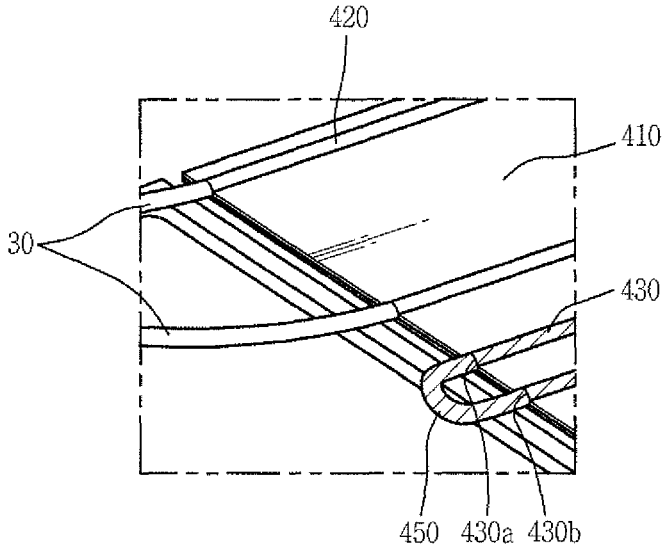
FIG. 13 is an enlarged view of a portion D illustrated in FIG. 11.
Figure 14:
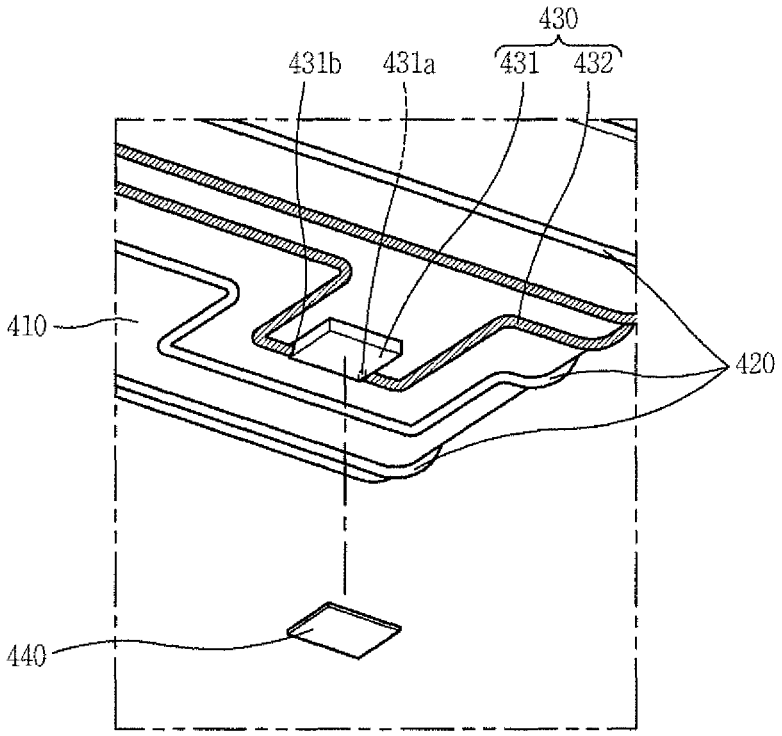
FIG. 14 is an enlarged view of a portion E illustrated in FIG. 12.

FIGS. 11 and 12 are conceptual diagrams illustrating a modification of the first embodiment, viewed in different directions, FIG. 13 is an enlarged view of portion D illustrated in FIG. 11, and FIG. 14 is an enlarged view of portion E illustrated in FIG. 12.

Referring to FIGS. 11 to 14, a second modification differs from the first embodiment only in that formation positions of the cooling tube 420 and the heating tube 430 are opposite to those of the first embodiment.

The cooling tube 420 is formed in a predetermined pattern in the case 410 and the inside of the cooling tube 420 is filled with a refrigerant R for cooling. The heating tube 430 is formed in a predetermined pattern in the case 410 so as not to overlap the cooling tube 420 and the inside of the heating tube 430 is filled with the working fluid W for defrosting.

In an evaporator 400 of the second modification, the formation positions of the cooling tube 420 and the heating tube 430 are opposite to those of the first embodiment. As shown, the cooling tube 420 is configured to enclose at least a portion of the heating tube 430. That is, a heating flow path formed by the heating tube 430 is formed in a loop-shaped cooling flow path formed by the cooling tube 420.

A heater 440 is attached to an outer surface of the case 410 corresponding to the heating tube 430 to heat the working fluid W in the heating tube 430. In the second modification, the heater 440 is attached to the bottom of the lower surface of the case 410 such that the heater 440 covers the heater attachment part 431, to heat the working fluid W in the heater attachment part 431.

As described above in the first embodiment, the heating tube 430 includes the heater attachment part or a heating chamber 431 and a flow path portion 432 or a portion adjacent to the heater attachment part 431. The heater attachment part 431 is formed at a position spaced apart inwards from an edge portion of the case 410, and a cooling tube 420 is provided on both sides.

The flow path portion 432 may extend along at least one surface of the case 410. In the second modification, the flow path portion 432 is formed to extend from the lower surface of the case 410 to both right and left side surfaces. The flow path portion 432 may extend even to the upper surface of the case 410. First and second openings 430*a* and 430*b* may be formed at the flow path portion 432 extending to the upper surface. The first and second openings 430*a* and 430*b* may be connected by a connection member 450 as described above in the first embodiment.

As in the first embodiment, the heater attachment part 431 has one outlet 431*a* and one inlet 431*b* and both end portions of the flow path portion 432 are connected to the outlet 431*a* and the outlet 431*b*, respectively, to form a single flow path for circulation of the working fluid W.

Specifically, the flow path portion 432 is connected to the outlet 431*a* and the inlet 431*b* of the heater attachment part 431 to form a heating flow path through which the working fluid W flows. The high temperature working fluid W heated by the heater attachment part 431 flows into the flow path portion 432 connected to the outlet 431*a* and the working fluid W cooled through heat dissipation flows returns to flow into the heater attachment part 431 through the flow path portion 432 connected to the inlet 431*b*.

Figure 15:
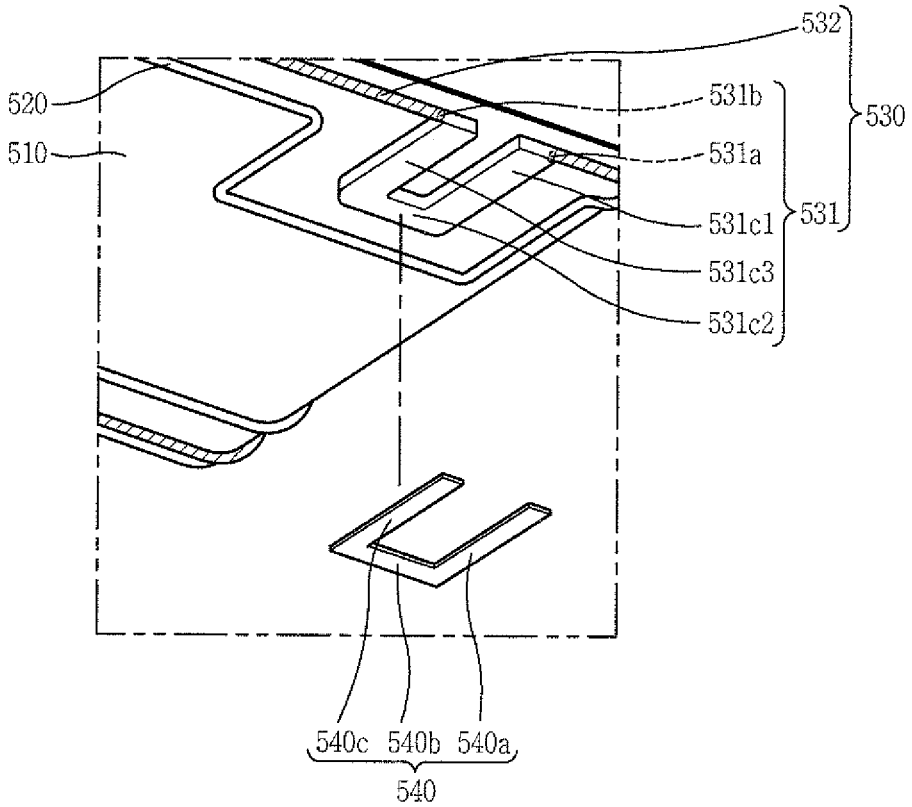
FIG. 15 is a conceptual view illustrating a second embodiment of the heating tube illustrated in FIG. 6.
Figure 16:
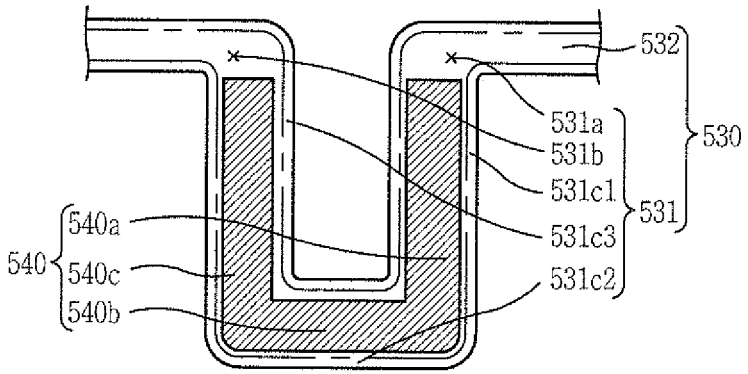
FIG. 16 is a conceptual view illustrating a state in which a heater is attached to a heater attachment part of FIG. 15.

FIG. 15 is a conceptual view illustrating a second embodiment of the heating tube 130 illustrated in FIG. 6, and FIG. 16 is a conceptual view illustrating a state in which a heater 540 is attached to a heater attachment part or a heating chamber 531 of FIG. 15.

Referring to FIGS. 15 and 16, a heating tube 530 is formed in a predetermined pattern on an evaporator case 510 so as not to overlap a cooling tube 520, and the inside of the heating tube 530 is filled with the working fluid W for defrosting. The heating tube 530 includes a heater attachment part 531 and a flow path portion 532 or a portion adjacent to the heater attachment part 531.

The heater attachment part 531 is formed as an empty space having a predetermined volume so that a predetermined amount of the working fluid W may stay therein. The heater attachment part 531 may be formed on a lower surface of the evaporator case 510. A heater 540 is attached to the heater attachment part 531 to heat the working fluid W therein. The heater 540 may be attached to the bottom of a lower surface of the evaporator case 510 corresponding to the heater attachment part 531.

An outlet 531*a* through which the working fluid W heated by the heater 540 is discharged and an inlet 531*b* to which the working fluid W cooled through the flow path portion 532 returns are formed on both sides of the heater attachment part 531. In this figure, the heater attachment part 531 is shown bent in a U-shape.

Specifically, the heater attachment part 531 includes a first portion 531*c*1 having an outlet 531*a*, a second portion 531*c*2 bent from the first portion 531*c*1 and connected, and a third portion 531*c*3 bent from the second portion 531*c*2, arranged to be parallel to the first portion 531*c*1, and having an inlet 531*b*. For reference, the heater 540 may be formed in a U shape corresponding to the first portion 531*c*1, the second portion 531*c*2, and the third portion 531*c*3 as illustrated.

According to the above structure, in the connecting portion between the first portion 531*c*1 and the second portion 531*c*2 and the connecting portion between the second portion 531*c*2 and the third portion 531*c*3, a flow direction of the working fluid W changes so part of the working fluid W stays, while forming a vortex in the connecting portions. The working fluid W staying, while forming a vortex, in the connecting portions serves as resistance interrupting flow of the working fluid W that subsequently flows in so part of the working fluid W stays in the heater attachment part 531. Thus, overheating of the heater 540 may be prevented.

The first portion 531*c*1, the second portion 531*c*2, and the third portion 531*c*3 may have the same width as that of the flow path portion 532 or may have a wider width than the flow path portion 532. In this figure, the first portion 531*c*1, the second portion 531*c*2, and the third portion 531*c*3 extend to have a width larger than the flow path portion 532.

The first portion 531*c*1 may be connected to one end of the flow path portion 532 in a bent shape and the third portion 531*c*3 may be connected to the other end portion of the flow path portion 532 in a bent shape.

With the above connection structure, the heated working fluid W discharged from the outlet 531*a* is changed in flow direction and flows into the flow path portion 532. Since the flow direction of the working fluid W is changed at the outlet 531*a*, part of the working fluid W stays, while forming a vortex at the outlet 531*a*. That is, the working fluid W that forms a vortex at the outlet 531*a* acts as a resistance that interrupts the flow of the working fluid W that flows in, and part of the working fluid W stays at the heater attachment part 531. In this way, not all of the heated working fluid W is directly discharged but part of the heated working fluid W is interrupted by the working fluid W which stays, while forming a vortex on the side of the outlet 531*a*, and stays in the heater attachment part 531 to which the heater 540 is attached, and thus, overheating of the heater 540 may be prevented.

Further, the working fluid W cooled while flowing in the flow path portion 532 is changed in flow direction and flows into the inlet 531*b*. Since the bending structure for generating flow resistance is formed at the inlet 531*b*, even through the re-heated working fluid W flows toward the inlet 531*b*, it is prevented by the working fluid W which stays, while forming a vortex at the inlet 531*b*, backflow of the heated working fluid W may be limited.

Meanwhile, as illustrated, the heater 540 may be formed in a U shape corresponding to the heater attachment part 531. Specifically, the heater 540 includes a first heater portion 540*a* provided to cover the first portion 531*c*1, a second heater portion 540*b* bent from the first heater portion and connected to cover the second portion 531*c*2, and a third heater portion 540*c* bent from the second heater portion 540*b*, connected to cover the third portion 531*c*3 and provided to be parallel to the first heater portion 540*a*.

The heater 540 may be attached to a flat surface of the heater attachment part 531. The first portion 531*c*1, the second portion 531*c*2, and the third portion 531*c*3 of the heater 540 may each have a size of 8 mm (width)×65 mm (length) or less. For attachment of the heater 540, the heater attachment part 531 may have design conditions of the heater attachment part 531 described in connection with the first embodiment. That is, protruding regions of the first portion 531*c*1, the second portion 531*c*2, and the third portion 531*c*3 are preferably set to a width of 10 mm or greater and 12 mm or smaller and a length of 47 mm or greater and 80 mm or smaller.

Figure 17:
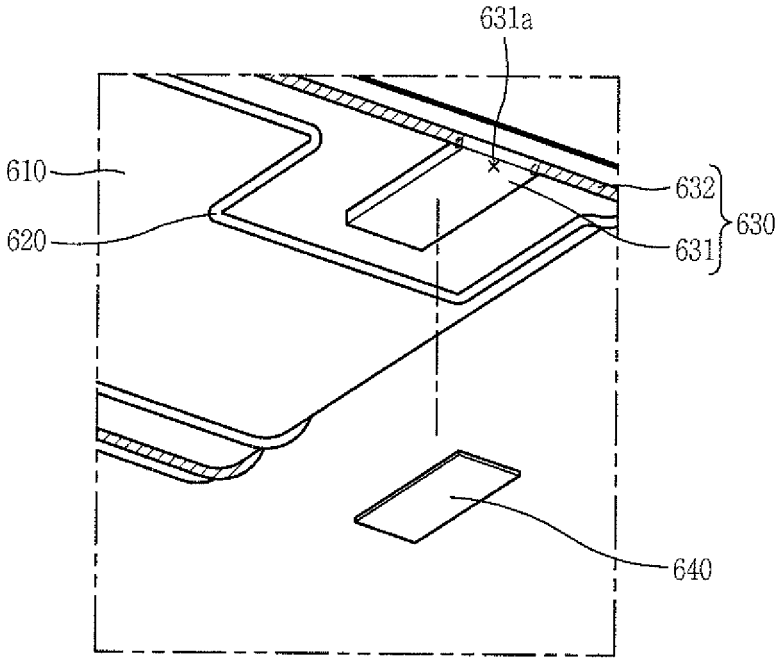
FIG. 17 is a conceptual view illustrating a third embodiment of the heating tube illustrated in FIG. 6.
Figure 18:
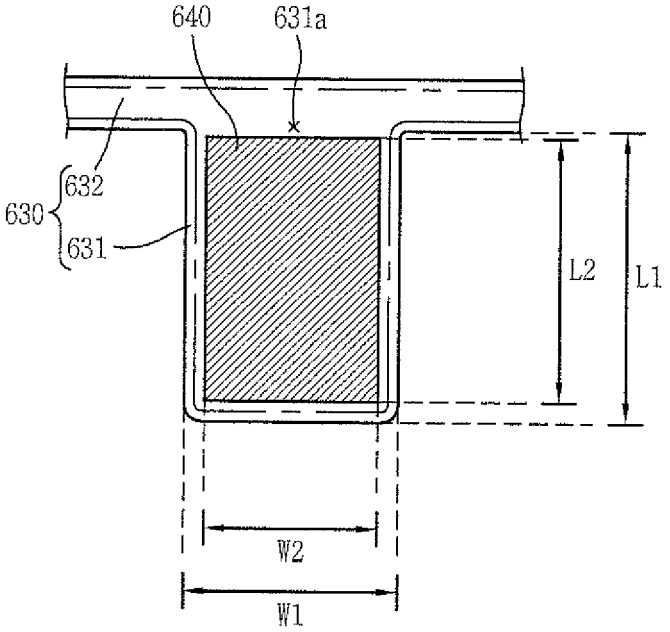
FIG. 18 is a conceptual view illustrating a state in which a heater is attached to a heater attachment part of FIG. 17.

FIG. 17 is a conceptual view illustrating a third embodiment of the heating tube 130 illustrated in FIG. 6, and FIG. 18 is a conceptual view illustrating a state in which a heater 640 is attached to a heater attachment part or a heating chamber 631 of FIG. 17.

Referring to FIGS. 17 and 18, a heating tube 630 is formed in a predetermined pattern in an evaporator case 610 so as not to overlap the cooling tube 620 and the inside of the heating tube 530 is filled with the working liquid W for defrosting. The heating tube 630 includes a heater attachment part or a heating chamber 631 and a flow path portion 632 or a portion of the heating tube 630 adjacent to the heating chamber.

The heater attachment part 631 is formed as an empty space having a predetermined volume so that a certain amount of the working fluid W may stay therein. The heater attachment part 631 may be formed on a lower surface of the evaporator case 610. A heater 640 is attached to the heater attachment part 631 to heat the working fluid W therein. The heater 640 may be attached to the bottom of a lower surface of the evaporator case 610 corresponding to the heater attachment part 631.

An opening 631*a* through which the working fluid W heated by the heater 640 is discharged and to which the working fluid W cooled, while flowing through the flow path portion 632, returns is formed on one side of the heater attachment part. That is, unlike the previous embodiments, only one opening 631*a* is formed at the heater attachment part 631 and the working fluid W are discharged and introduced through the opening 631*a*.

Although it is illustrated that the heater attachment part 631 is formed in a straight line form, the present invention is not limited thereto. The heater attachment part 631 may have a bent shape at least in part.

The flow path portion 632 communicates with the opening 631*a* of the heater attachment part 631 to form a flow path through which the working fluid W circulates. It may be understood that the heater attachment part 631 is branched from the flow path portion 632. In this figure, the heater attachment part 631 is shown to extend perpendicularly to the flow path portion 632.

With the above structure, the flow path portion 632 has a shape extending toward both sides with respect to the opening 631*a* of the heater attachment part 631. The heated working fluid W is charged through the flow path portion 632 extending to one side with respect to the opening 631*a*, and the working fluid W cooled while flowing through the flow path portion 632 returns to the flow path portion 632 extending to the other side with respect to the opening 631*a*. That is, although the heater attachment part 631 has one opening 631*a*, the working fluid W is naturally discharged and introduced through the branched flow path portion 632 by the flow path portion 632 branched to both sides with respect to the opening 631*a*.

Since the working fluid W is discharged from and introduced to the opening 631*a* of the heater attachment part 631 and the heater attachment part 631 extends to be perpendicular to the flow path portion 632, the discharged and introduced working fluid W is changed in flow direction in the opening 631*a*. As a result, part of the working fluid W stays, while forming a vortex, in the opening 631*a*, so that overheating of the heater 640 may be prevented.

The heater attachment part 631 is formed on the lower surface of the evaporator case 610 and is provided adjacent to one side surface of the evaporator case 610 so as to form a circulating flow due to a lifting force of the heated working fluid W, and the heater attachment part 631 communicating with the opening 631*a* of the heater attachment part 631 may extend toward the upper side of the evaporator case 610.

Specifically, the heater attachment part 631 formed on the lower surface of the evaporator case 610 may be provided adjacent to one side surface of the evaporator case 610. For example, when the heater attachment part 631 is provided adjacent to the right side surface of the evaporator case 610, a gap between the heater attachment part 631 and the right side surface is formed to be shorter than a gap between the heater attachment part 631 and the left side surface.

The flow path portion 632 branched to both sides of the opening 631*a* of the heater attachment part 631 extends to both left and right side surfaces of the evaporator case 610. If a distance for the flow path portion 632 to reach the right side surface of the evaporator case 610 is shorter than a distance for the flow path portion 632 to reach the left side surface of the evaporator case 610, the heated working fluid W flows to the flow path portion 632 extending to the right side surface of the evaporator case 610. Accordingly, a circulating flow of the working fluid W is produced.

The flow path portion 632 may be formed to enclose at least part of the cooling tube 620 formed at the evaporator case 610 so as to extend along the inner circumference of the evaporator case 610.

A plate-shaped ceramic heater may be used as the heater 640. Such a plate-shaped ceramic heater may have a size of 8 mm (width)×45 mm (length) or 8 mm (width)×65 mm (length). In this case, a protruding area or region (W1 (width)×(length)) in which the heater attachment part 631 is formed preferably has a width W1 from 10 mm to 12 mm and a length L1 from 47 mm to 80 mm.

Since a thickness of a rounded edge portion in the protruding region in which the heater attachment part 631 is formed is approximately 1 mm, the protruding region must have a length and a width obtained by adding thicknesses 2 mm of both sides of the rounded protruding portion to the length and width of the heater 640.

Therefore, in order for the heater 640 to be completely in surface-contact with a flat portion (W2 (width)×L2 (length)) of the protruding region, the protruding region is preferably set to a width of 10 mm or greater and a length of 47 mm or greater.

However, if the width of the protruding region is set to 47 mm or greater and the width of the protruding region exceeds 12 mm, the first and second case sheets may be separated or fractured in the process of forming the cooling tube 620 and the heating tube 630. Also, if the length of the protruding region exceeds 80 mm, the first and second case sheets may be separated or fractured in the process of forming the cooling tube 620 and the heating tube 630.

Therefore, it is preferable that the protruding region is set to a width of 10 mm or greater and 12 mm or smaller and a length of 47 mm or greater and 80 mm or smaller.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An evaporator comprising:

an evaporator case having first and second case sheets coupled to each other and bent to form a storage space therein;

a cooling tube provided by a first channel formed between the first and second case sheets and forming a cooling circulation path in which a refrigerant flows;

a heating tube provided by a second channel formed between the first and second case sheets in which a working fluid flows;

a heating chamber formed to protrude from a bottom surface of the evaporator case, wherein a space for temporarily storing the working fluid is formed in the heating chamber, the heating chamber including an outlet and an inlet connected to first and second ends of the heating tube, respectively, to form a heating circulation path through which the working fluid circulates; and a heater provided on an outer surface of the evaporator case at a position corresponding to where the heating chamber is formed to heat the working fluid, wherein the working fluid heated by the heater is discharged through the outlet, and wherein cooled working fluid returns through the inlet.

2. The evaporator of claim 1, wherein the outlet and the inlet are provided at sides of the heating chamber.

3. The evaporator of claim 2, wherein the heater is provided on a lower surface of the evaporator case corresponding to the position of the heating chamber.

4. The evaporator of claim 2, wherein the evaporator case has a box shape having a first opened side opposite to a second opened side, the heating chamber is adjacent to a side surface of the evaporator case, and a portion of the heating tube communicating with either the inlet or the outlet of the heating chamber extends to the side surface circulation such that the heated working fluid circulates via a lifting force.

5. The evaporator of claim 1, wherein the heating tube includes at least one of a first bent portion adjacent to the outlet to change a flow direction of the working fluid discharged from the outlet, and a second bent portion adjacent to the inlet and changing a flow direction of the working fluid to allow the working fluid to flow into the inlet.

6. The evaporator of claim 1, wherein the heating chamber includes:

an extension region having the same width as that of the heating tube; and an expansion region configured to expand the width of the extension region.

7. The evaporator of claim 1, wherein a width of the heating chamber is 10 mm to 12 mm.

8. The evaporator of claim 7, wherein a length of the heating chamber is 47 mm to 80 mm.

9. The evaporator of claim 1, wherein the heating chamber includes:

a first portion having the outlet;

a second portion connected to and bent from the first portion; and a third portion connected to and bent from the second portion, wherein the third portion is parallel to the first portion and has the inlet.

10. The evaporator of claim 9, wherein the first portion is connected to and bent from the first end of the heating tube and the third portion is connected to and bent from the second end of the heating tube.

11. The evaporator of claim 9, wherein the heater includes:

a first heater portion provided to cover the first portion of the heating chamber;

a second heater portion connected to and bent from the first heater portion and provided to cover the second portion; and a third heater portion connected to and bent from the second heater portion and provided to cover the third portion and to be parallel to the first heater portion.

12. The evaporator of claim 1, wherein the first channel comprises at least one first groove formed in the first case sheet and at least one second groove formed in the second case sheet, and the second channel comprises at least one third groove formed in the first case sheet and at least one fourth groove formed in the second case sheet, such that when the first and second case sheets are coupled to each other, at least one first groove and at least one second groove align with each other to form the cooling tube, and at least one third groove and at least one fourth groove align with each other to form the heating tube, wherein the first to fourth grooves have a semicircular cross-sectional shape, respectively, the cooling tube and the heating tube have a circular cross-sectional shape, respectively, and two semicircles are disposed to face each other to form a single circle.

13. An evaporator comprising:

an evaporator case having first and second case sheets coupled to each other and bent to form a storage space;

a cooling tube provided by a first channel formed between the first and second case sheets and forming a cooling circulation path in which a refrigerant flows;

a heating tube provided by a second channel formed between the first and second case sheets in which a working fluid flows;

a heating chamber formed to protrude from a bottom surface of the evaporator case, wherein a space for temporarily storing the working fluid is formed in the heating chamber, the heating chamber including an opening formed on a side of the heating chamber to communicate with the heating tube to form a heating circulation path through which the working fluid circulates; and a heater provided on an outer surface of the evaporator case at a position corresponding to where the heating chamber is formed to heat the working fluid, wherein the opening of the heating chamber is configured to allow the working fluid heated by the heater to be discharged and cooled working fluid to be returned therethrough.

14. The evaporator of claim 13, wherein the evaporator case has a box shape having a first opened side opposite to a second opened side, the heating chamber is formed on the bottom surface of the evaporator case and provided near a side surface of the evaporator case, and a portion of the heating tube communicating with the opening extends to the side surface to circulate such that the heated working fluid circulates via a lifting force.

15. The evaporator of claim 13, wherein the heating chamber extends in a direction perpendicular to a longitudinal direction of the heating tube.

16. The evaporator of claim 13, wherein a width of the heating chamber is 10 mm to 12 mm.

17. An evaporator, comprising:

a case having an inner layer and an outer layer;

a first channel formed between the inner and outer layers in which a first refrigerant flows;

a second channel formed between the inner and outer layers in which a second refrigerant flows;

a fluid chamber formed to protrude from a bottom surface of the case, wherein a space for temporarily storing the first refrigerant is formed in the fluid chamber, the fluid chamber configured to communicate with the first channel; and a heater adhered to the outer layer at a position corresponding to the fluid chamber.

18. The evaporator of claim 17, wherein the fluid chamber is provided by a space formed between the inner and outer layers and includes an inlet and an outlet, wherein the first channel connects to the inlet and the outlet such that the first refrigerant is circulated through a first loop formed by the first channel, the inlet, the fluid chamber, and the outlet.

19. The evaporator of claim 18, wherein an extension connects ends of the second channel to form a second loop through which the second refrigerant is circulated, wherein the first and second channels are formed in at least two sides of the case, and wherein one of the first loop and the second loop encloses the other one of the first loop and the second loop.

20. The evaporator of claim 18, wherein the first channel has a width that is less than a width of the fluid chamber, and wherein the first channel is bent to provide a resistance to the flow of the first refrigerant before the first refrigerant enters the inlet, or to provide a resistance to the flow of the first refrigerant after the first refrigerant exits the outlet, such that the first refrigerant forms a vortex where the first channel is bent.

* * * * *